US009506260B2

(12) United States Patent
Mussa

(10) Patent No.: US 9,506,260 B2
(45) Date of Patent: Nov. 29, 2016

(54) CONTINUOUS INFLATABLE TUBE FOR CANVAS POOLS

(76) Inventor: Eduardo Alberto Mussa, Provincia de Buenos Aires (AR)

( * ) Notice: Subject to any disclaimer, the term of this patent is extended or adjusted under 35 U.S.C. 154(b) by 148 days.

(21) Appl. No.: 14/342,044

(22) PCT Filed: Aug. 31, 2012

(86) PCT No.: PCT/EP2012/067033

§ 371 (c)(1),
(2), (4) Date: Feb. 28, 2014

(87) PCT Pub. No.: WO2013/030379

PCT Pub. Date: Mar. 7, 2013

(65) Prior Publication Data

US 2014/0201899 A1 Jul. 24, 2014

(30) Foreign Application Priority Data

Sep. 1, 2011 (AR) ..... M110103208 U

(51) Int. Cl.
*E04H 4/00* (2006.01)

(52) U.S. Cl.
CPC ..... *E04H 4/0025* (2013.01); *E04H 4/00* (2013.01)

(58) Field of Classification Search
CPC ..... E04H 4/0025
USPC ..... 4/488–513
See application file for complete search history.

(56) References Cited

U.S. PATENT DOCUMENTS 2,084,236 A * 6/1937 Babb ..... A47K 3/06 4/507
2,216,871 A * 10/1940 Banks ..... B63B 7/08 43/55
3,021,536 A * 2/1962 Haggerty ..... B63B 7/08 114/345
5,628,658 A * 5/1997 Clifford ..... A47C 15/006 441/130
6,571,405 B1 * 6/2003 Saputo ..... E04H 4/0025 220/613
9,254,240 B2 * 2/2016 Lin ..... A61H 33/028

* cited by examiner

*Primary Examiner* — Lori Baker
(74) *Attorney, Agent, or Firm* — Blakely Sokoloff Taylor & Zafman LLP

(57) ABSTRACT

Continuous inflatable tube for canvas pools comprising an inflatable perimeter ring or tube that defines the upper edge of the swimming pool, wherein the ring or tube is a continuous and whole strip, without seams or seals, and comprising a lower longitudinal flange of about 3 or 4 cm which is used to weld said tube to the edge of the canvas pool.

Said continuous inflatable tube consists in a strip of flexible material, preferably PVC, which forms a continuous cylindrical ring welded by radio frequency to the upper end edge of the sidewalls of the canvas pool, comprising at least one inflating valve, whereby the user will inflate the tube to the desired volume.

4 Claims, 2 Drawing Sheets

CONTINUOUS INFLATABLE TUBE FOR CANVAS POOLS

This is a national stage of PCT/EP12/067033 filed Aug. 31, 2012 and published in English, which has a priority of Argentina no. 20110103208 filed Sep. 1, 2011, hereby incorporated by reference.

TECHNICAL FIELD

The proposed invention relates to the upper inflatable edge of canvas pools, particularly to a continuous inflatable tube for canvas pools, such as those which comprise an upper inflatable ring or tube that defines the upper edge of those canvas pools.

PRIOR ART

A number of canvas pools are known in the art, the most popular ones being those comprising a canvas body held by a skeleton framing made of pipes embedded through corners, which define a pipe upper edge and a series of legs or headers and side supports.

An example of canvas pools that form part of the closest prior art are the canvas pools with an inflatable upper edge which, depending on the pool's configuration (either rectangular or circular), may or may not have side support legs. These types of swimming pools meant an important step in the prior art by removing the perimeter tubular structure and replacing it with an inflatable perimeter tube or ring that defines the upper edge of those pools.

One of the inconveniences that appeared as a result of this new configuration arises in the manufacturing process. The inflatable tube is made of a continuous film folded in the middle, which is welded to the edge of the canvas pool, and then another welding line is applied as reinforcement. In the swimming pools of the prior art, these two welding lines can be seen with a separation of approximately 2 centimeters.

This risky system of double welding resulted in many units having pinholes, as a consequence of excessive welding or other human mistakes happening along this process. This implies an important amount of defective units, with water leaks if the pinhole is on the first welding line, or the subsequent deflation of the tube in case the defect is on the second welding line, causing the need to repair, patch or, at worst, replace the swimming pool.

Another related inconvenience is the time and labor consumed in the double welding of the entire pool's edge, which causes high costs, delays, and waste of materials.

So there is a need to have an inflatable ring or tube system which simplifies the welding operation preventing or minimizing the risk of pinholes; which reduces time of operation and labor and material costs.

BRIEF DESCRIPTION OF THE INVENTION

The object of the invention consists in a continuous inflatable tube for canvas pools comprising a seamless one-span continuous tube, which has a continuous flange in its lower part, to be welded to the edge of the canvas pool.

DETAILED DESCRIPTION OF THE INVENTION

Figure 1:
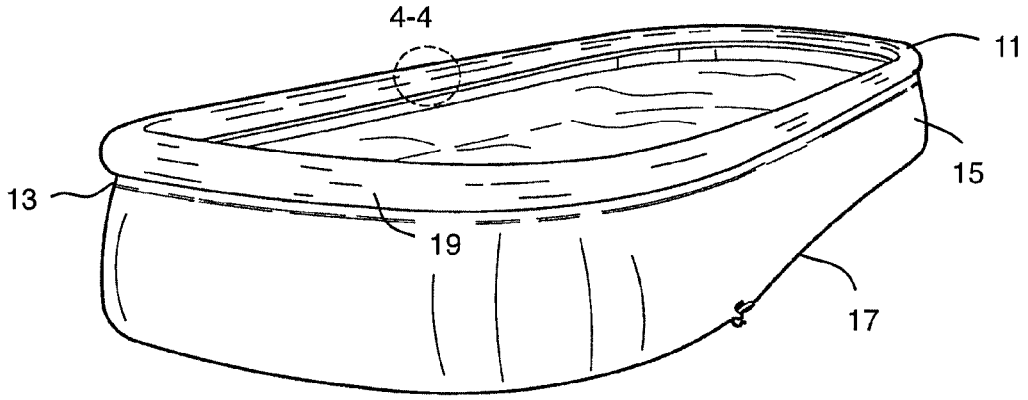
FIG. 1 represents a top perspective view of the continuous inflatable tube for canvas pools.
Figure 2:
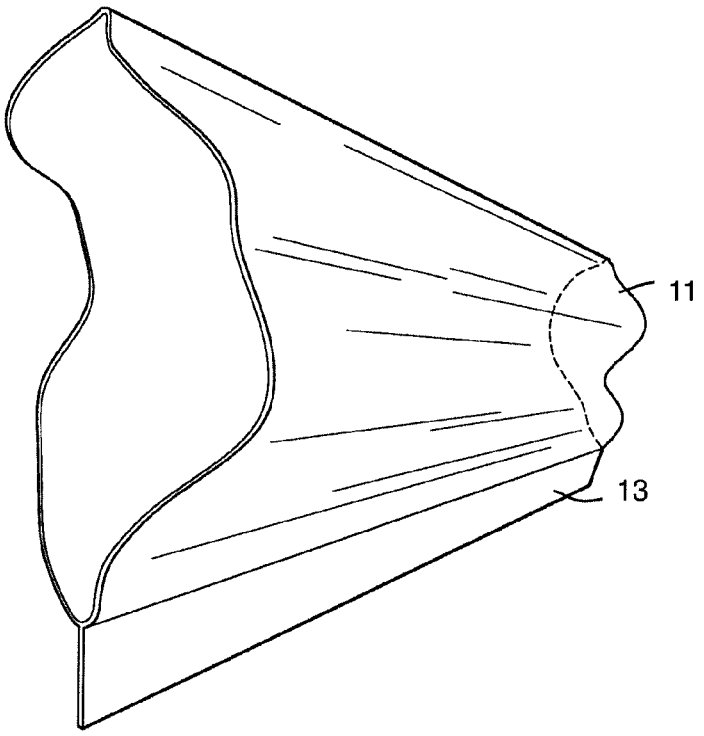
FIG. 2 represents a magnified detail in perspective of a stretch of the inflatable tube before being inflated, showing the continuous lower flange.
Figure 3:
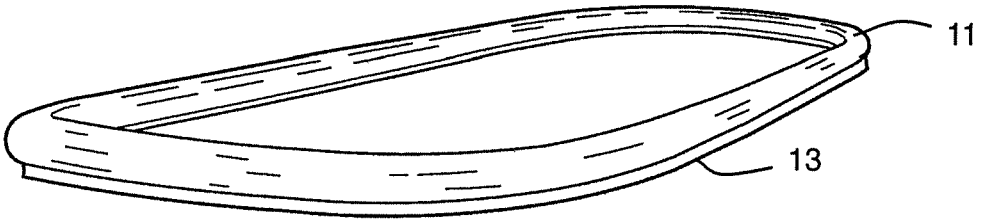
FIG. 3 represents a top perspective view of the inflatable tube alone, without the canvas pool, showing the continuous lower flange which will be used to weld the tube to the swimming pool.
Figure 4:
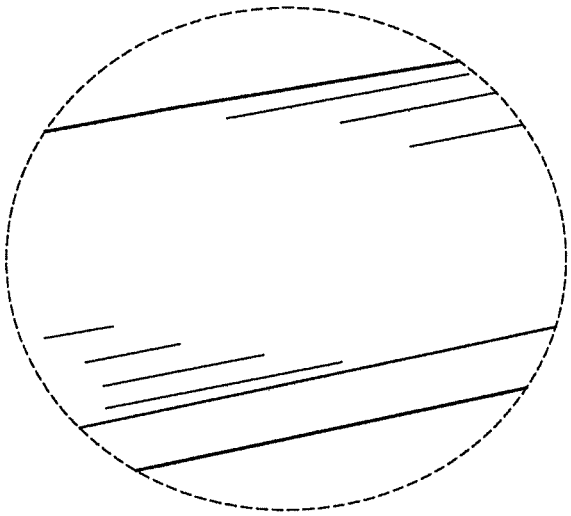
FIG. 4 represents a perspective view showing in detail the area of the inflatable tube indicated in FIG. 1.

As shown in FIGS. 1-4, the proposed invention consists in a continuous inflatable tube for canvas pools, comprising an inflatable perimeter ring or tube that defines the upper edge of the swimming pool, wherein the ring or tube is a continuous and whole strip 11, without seams or seals, and comprising a lower longitudinal flange 13 of about 3 or 4 cm which is used to weld said tube to the edge 15 of the canvas pool 17.

Said inflatable continuous tube consists in a strip of flexible material, preferably PVC, which forms a continuous cylindrical ring welded by radio frequency to the upper end edge of the sidewalls of the canvas pool, comprising at least one inflating valve 19, whereby the user will inflate the tube to the desired volume.

The tube is manufactured with PVC lump, packed in 25 kg bags and can be colored, clear or crystal. The PVC lump is placed on the hopper of the extrusion machine, which works at a temperature of approximately 215° C. melting the material in order to pass it later through a jacket that provides the continuous shape of circular diameter, and then it is inflated to obtain the required diameter. Subsequently, the tube passes through the gauge, where it is given the final size and is cooled to be rolled up. Rolls can be of 30 to 50 meters, or more if necessary.

The extruding PVC that is used to manufacture this tube must meet certain required technical characteristics, namely, a 84 shore hardness, 1.24 g/cm$^3$ density, and 52 mpa plasticity.

Preferably, this material also has a UV protector against ultraviolet rays, high impact to resist possible punctures, and an anti-tack to prevent the sides of the tube from sticking naturally when rolled up.

Once the rolls of PVC are made, these are received and the edge of the canvas pool is prepared so that the rolled-up tube can be welded, which adapts to swimming pools of any model and size.

The continuous longitudinal flange is placed on the upper canvas edge and is welded by radio frequency in only one step, without further requiring the application of a second welding line or subsequent adjustments.

The advantages of the claimed continuous inflatable tube for canvas pools are the following: as it is a uniform whole inflatable tube without seams, openings or outline cuttings, it is unlikely that it may crack or have any fissures. Besides, it has no waste as it is a sole continuous cylindrical piece.

From the operative point of view, with the addition of the new shape of the seamless continuous longitudinal flange, the welding practical task of the tube is favored as it makes it faster and less complicated. By removing the second welding line due to the presence of the flange, not only is labor time saved, but this also increases safety and efficiency, thus eliminating or minimizing the possibility of having defective products that may need to be repaired or directly discontinued.

There is no doubt that when this invention is put into practice, modifications may be introduced regarding certain details of construction and shape, without this implying deviating from the fundamental principles that are clearly based on the following claims.

The invention claimed is:

1. A continuous inflatable tube for canvas pools comprising:

an inflatable upper edge of a flexible material of a canvas pool, comprising a substantially cylindrical continuous and whole strip, without seams or seals, outline cuttings or openings, except for at least one inflating valve, and a lower continuous longitudinal flange for being welded in a sole welding line to an edge of the canvas pool; wherein said tube has a UV protector against ultraviolet rays, high impact to resist possible punctures and an anti-tack to prevent the sides of the tube from sticking naturally when rolled up.

2. The continuous inflatable tube for canvas pools according to claim 1, wherein the flexible material is PVC.

3. A process of making a canvas pool using a substantially cylindrical continuous inflatable tube including a continuous integral flange, said inflatable tube without seams or welds, outline cuttings or openings, except for at least one inflating valve, comprising the following steps:

placing a PVC lump in an extrusion machine to produce a melted material, placing the melted material through a jacket in order to obtain the substantially cylindrical continuous inflatable tube comprising the continuous longitudinal flange, placing said continuous longitudinal flange of the tube on an upper canvas edge of said canvas pool, and welding said continuous longitudinal flange on the upper canvas edge by radio frequency.

4. A canvas pool comprising (1) a sidewall, (2) an edge, and (3) the continuous inflatable tube of claim 1, wherein the continuous inflatable tube is welded in a sole welding line to the edge of the canvas pool via the continuous longitudinal flange.

* * * * *